US008435043B2

(12) United States Patent
Yu et al.

(10) Patent No.: US 8,435,043 B2
(45) Date of Patent: May 7, 2013

(54) POWER CONNECTOR ASSEMBLY

(75) Inventors: Wang-I Yu, Jhonghe (TW); Hung-Chi Tai, Jhonghe (TW); Kuo-Cheng Liu, Jhonghe (TW)

(73) Assignee: Alltop Electronics (Suzhou) Co., Ltd, Taicang (CN)

( * ) Notice: Subject to any disclaimer, the term of this patent is extended or adjusted under 35 U.S.C. 154(b) by 261 days.

(21) Appl. No.: 12/961,999

(22) Filed: Dec. 7, 2010

(65) Prior Publication Data

US 2011/0076871 A1 Mar. 31, 2011

Related U.S. Application Data

(63) Continuation-in-part of application No. 12/190,955, filed on Aug. 13, 2008, now Pat. No. 7,980,860.

(30) Foreign Application Priority Data

Jun. 9, 2010 (CN) ..... 2010 1 0195655

(51) Int. Cl.
*H01R 12/00* (2006.01)

(52) U.S. Cl.
USPC ..... 439/65

(58) Field of Classification Search ..... 439/65, 439/78–79, 825–827, 345, 660, 485, 206, 439/101, 637, 290, 295, 857, 855, 682, 510–512, 439/907, 947
See application file for complete search history.

(56) References Cited

U.S. PATENT DOCUMENTS

| | | | | |
|---|---|---|---|---|
| 5,215,471 | A | 6/1993 | Reymond et al. | |
| 5,431,576 | A | 7/1995 | Matthews | |
| 6,319,075 | B1 | 11/2001 | Clark et al. | |
| 6,568,943 | B2 | 5/2003 | Okayasu et al. | |
| 6,848,950 | B2 * | 2/2005 | Allison et al. | 439/682 |
| 6,890,221 | B2 * | 5/2005 | Wagner | 439/855 |
| 7,425,145 | B2 * | 9/2008 | Ngo | 439/290 |
| 7,458,839 | B2 | 12/2008 | Ngo et al. | |
| 7,666,025 | B2 | 2/2010 | Cheng et al. | |
| 7,726,982 | B2 * | 6/2010 | Ngo | 439/79 |
| 2008/0146091 | A1 | 6/2008 | Tyler | |
| 2009/0142953 | A1 * | 6/2009 | Patel et al. | 439/345 |

FOREIGN PATENT DOCUMENTS

| | | | |
|---|---|---|---|
| CN | 201171093 | Y | 12/2008 |

* cited by examiner

*Primary Examiner* — Edwin A. Leon
(74) *Attorney, Agent, or Firm* — Sughrue Mion, PLLC

(57) ABSTRACT

A power connector assembly includes a first connector (100) having a first insulating housing (110) forming a front face (114) and a rear face (115). A number of passageways (101) are defined in the first insulating housing and extending through the front face and the rear face. A number of first contacts (120) are retained in the passageways, respectively. A second connector (200) includes a second insulating housing (210) having a front surface (214) and a rear surface (215). A number of passageways (201) are defined in the second insulating housing and extending through the front surface and the rear surface. A number of second contacts (220) are retained in the passageways, respectively. When the first connector and the second connector are mated with each other along a mating direction, a number of airflow holes (102) are defined between the front face of the first connector and the front surface of the second connector for heat dissipation.

15 Claims, 11 Drawing Sheets

POWER CONNECTOR ASSEMBLY

CROSS-REFERENCE TO RELATED APPLICATIONS

This application is a Continuation-in-part Application of U.S. patent application Ser. No. 12/190,955, filed Aug. 13, 2008, and entitled "POWER CONNECTOR ASSEMBLY", which has the same assignee as the present invention.

BACKGROUND OF THE INVENTION

1. Field of the Invention

The present invention relates to a power connector, and more particularly to an assembly of a receptacle and a plug connectors for transmitting power between circuit boards.

2. Description of Related Art

Designers of electronic circuits generally are concerned with two basic circuit portions, the logic or signal portion and the power portion. In designing logic circuits, the designer usually does not have to take into account any changes in power properties, such as resistance of circuit components that are brought about by changes in conditions, such as temperature, because current flows in logic circuits are usually relatively low. However, power circuits can undergo changes in power properties because of the relatively high current flows. Consequently, connectors designed for use in power circuits must be capable of dissipating heat (generated primarily as a result of the Joule effect) so that changes in circuit characteristics as a result of changing current flow are minimized.

U.S. Pat. No. 6,319,075 discloses a power connector assembly used in power transmission application, which includes a receptacle connector and a mating plug connectors assembled on a circuit board, the receptacle connector includes an insulating receptacle housing and receptacle contact assembly assembled in the insulating receptacle housing, the plug connector has an insulating plug housing and plug contact assembly assembled in the insulating plug housing. Each of the receptacle contact includes two pieces of planar base portions connected on the top, and an upper and a lower curved contacting arms extending forwardly from the front of the base portion. When the receptacle connector is mated with the plug connector, the plug and the receptacle contacting arms resiliently contact with each other, the receptacle contact deforms under the pressing force when the plug contact being inserted, while the U shaped connection portion on top of the planar base portions of the receptacle contact can provide an opposite supportive force to keep the contacting portion of the receptacle contact from over deforming. Also, the receptacle as disclosed in this patent is configured in one piece, the connection portion of the base portion of the contact is U shaped, which needs to be bent after the base portion of the contact has been stamped, the process of bending normally results in a crack of the contact at a position where is bent, consequently the power conductive characteristics of the material could be influenced and the quality could be affected also. Moreover, the high temperature during welding could also cause the relief of the inner metal stress of the bent contact, which could influence the precision of welding foot of the contact due to the expanding of the contact, as a result, the contact could not be smoothly contacted with circuit board or the welding foot of the contact could also be broken.

To overcome the disadvantages as disclosed in this patent, another Chinese Utility Model patent No. 200820031892.1 of the present applicant on an invention of a power connector assembly and mating contacts used thereof discloses an improved receptacle contact. Each of the receptacle contact pair includes a pair of independent receptacle contacts. Each of the receptacle contacts includes a rectangular planar base portion, a mounting leg extending downwardly from the base portion, and a contacting arm extending forwardly from the base portion. The receptacle contact is configured in two pieces and manufactured directly by injection mould without the above problems occurred during bending process, therefore the quality can be effectively improved while the cost of manufacturing can be reduced, also it can be easily assembled, the manufacturing process becomes simple while the quality can be stabilized. In addition, because no connection or support is provided between the receptacle contacts, the contacting arm of the receptacle contact intends to be over deformed or crumpled due to the pressing force exerted when the plug contact is inserted into the contacting arm of the receptacle contacts, therefore the performance of power transmission of the receptacle contacts could be influenced.

Therefore, an improved power connector assembly for delivering power between circuit boards is required.

BRIEF SUMMARY OF THE INVENTION

A power connector assembly in accordance with the present invention includes a plug connector and a mated receptacle connector. The plug connector has a first insulating housing forming a front face and a rear face. A number of passageways are defined in the first insulating housing and extending through the front face and the rear face. A number of first contacts are retained in the passageways, respectively. The receptacle connector includes a second insulating housing having a front surface and a rear surface. A number of passageways are defined in the second insulating housing and extending through the front surface and the rear surface. A number of second contacts are retained in the passageways, respectively. When the first connector and the second connector are mated with each other along a mating direction, a number of airflow holes are defined between the front face of the first connector and the front surface of the second connector for heat dissipation.

BRIEF DESCRIPTION OF THE DRAWINGS

The present invention is further described with reference to the accompanying drawings in which.

DETAILED DESCRIPTION OF THE INVENTION

Figure 1:
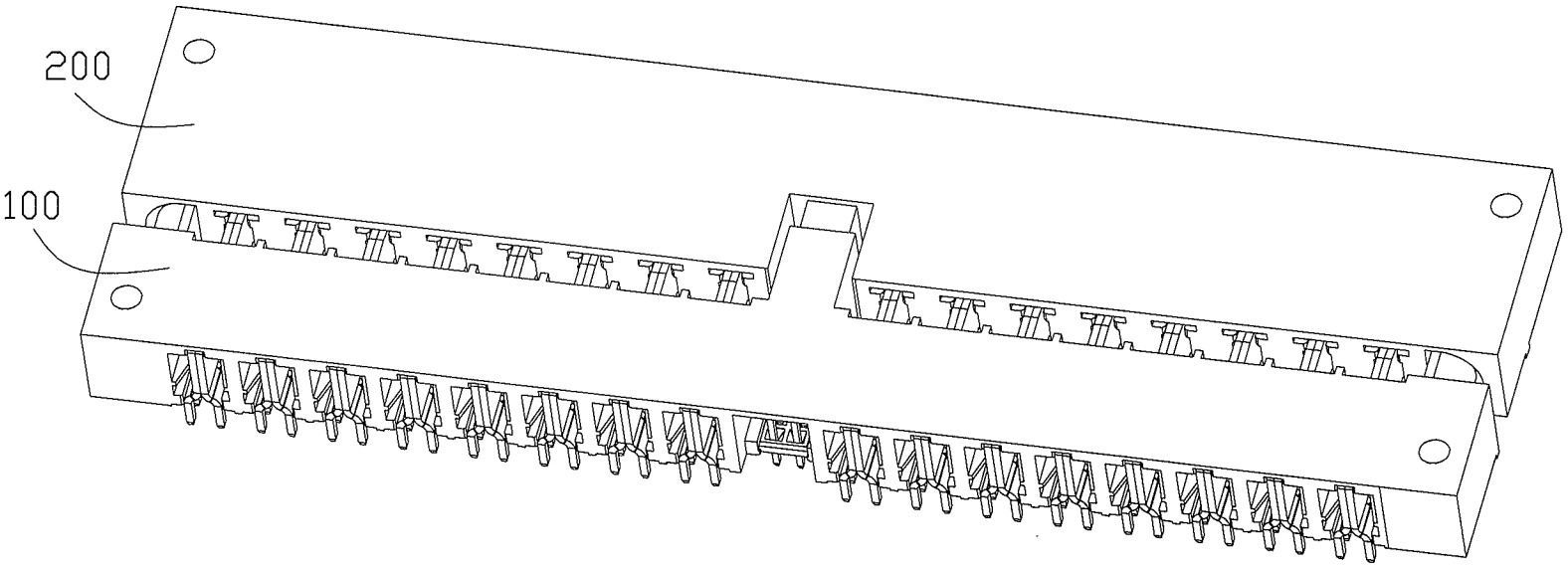
FIG. 1 is a perspective view of a power connector assembly in accordance with the present invention.

Reference will now be made to the drawing figures to describe the present invention in detail.

Referring to FIG. 1, a power connector assembly according to the present invention includes a pair of mated power connectors, i.e. a first power connector and a second power connector, contacts of each connector being mated for realizing the transmission of high voltage and current. As a preferred embodiment of the present invention, the first power connector is a plug 100 and the second power connector is a receptacle 200. The plug 100 and the receptacle 200 are assembled on two circuit boards (not shown), respectively, and can be mated with each other for power transmission between such two circuit boards.

Figure 2:
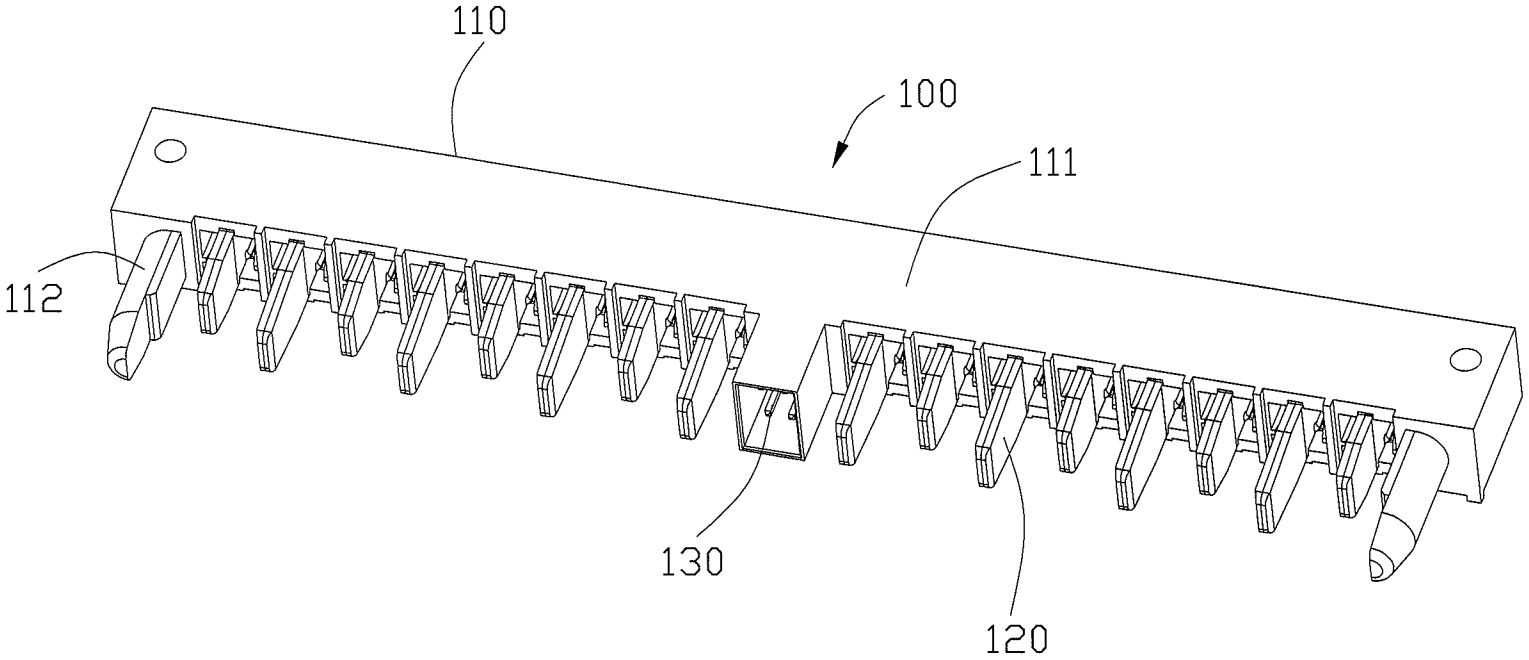
FIG. 2 is a perspective view of a plug of the power connector assembly shown in FIG. 1.
Figure 3:
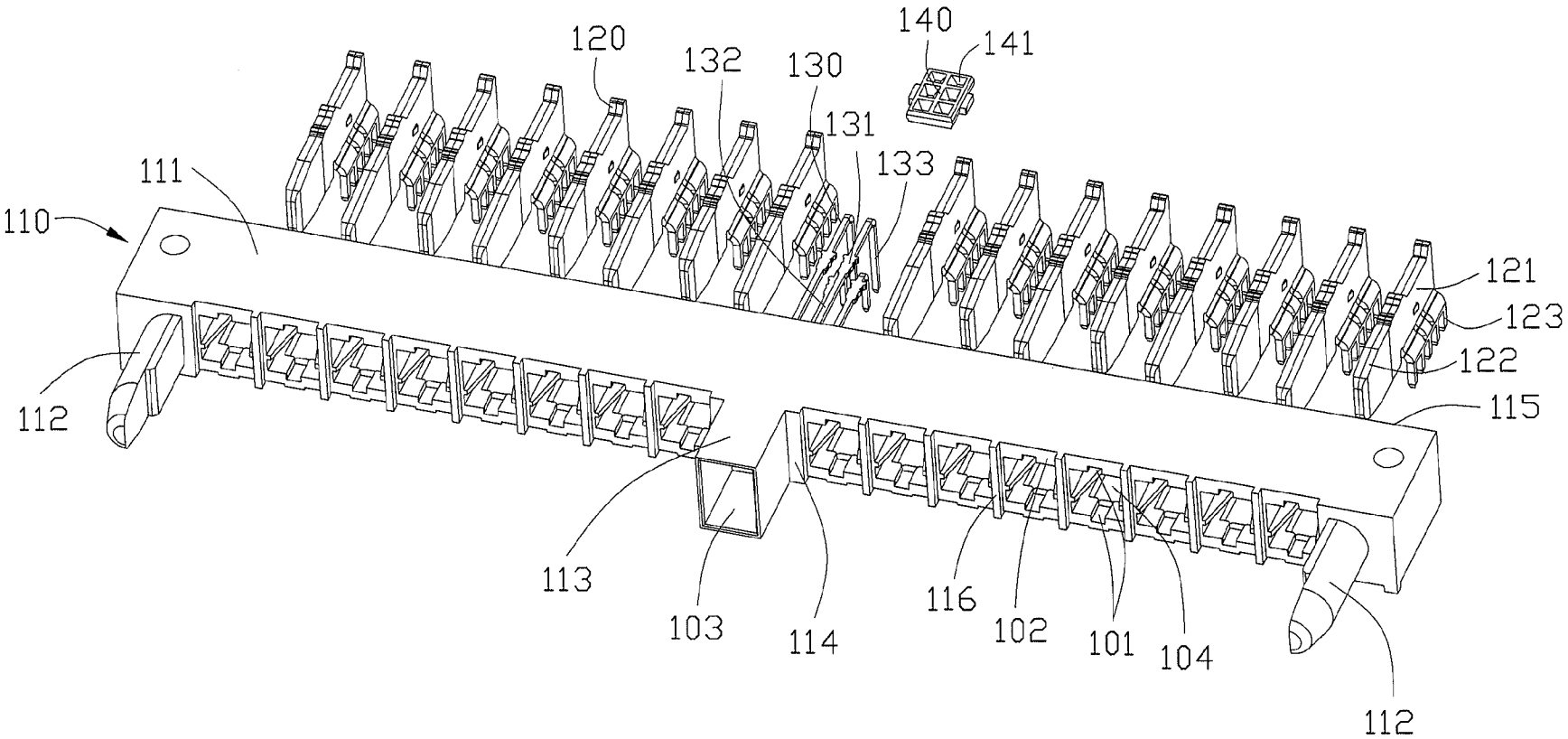
FIG. 3 is an exploded, perspective view of the plug shown in FIG. 2.
Figure 4:
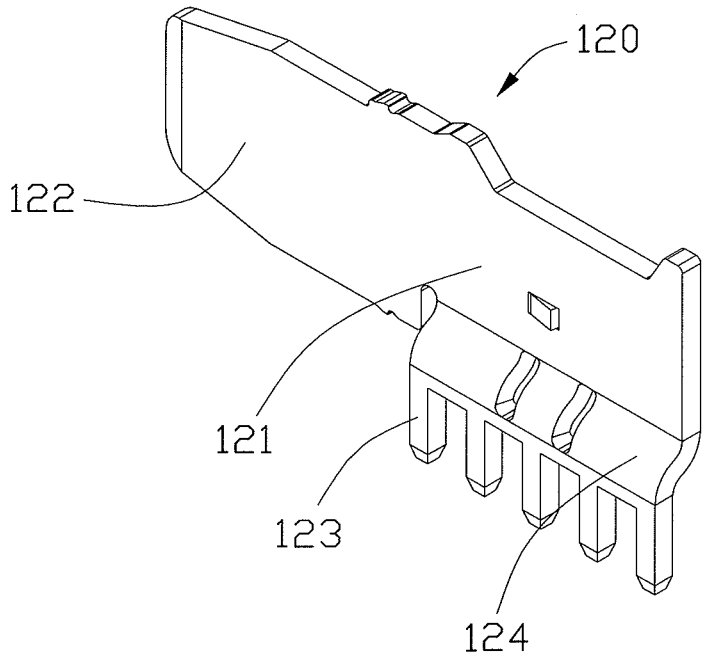
FIG. 4 is a perspective view of one contact element of the plug shown in FIG. 3.

Together referring to FIGS. 2 and 3, the plug 100 includes an elongated, insulating plug housing 110 and a plurality of first plug contacts 120 and second plug contacts 130 retained in the insulating plug housing 110. The insulating plug housing 110 forms a top face 111, a front mating face 114 and an opposite, rear face 115. A plurality of passageways 101 are defined in an array in the housing 110 and extending through the front mating face 114 and the opposite rear face 115. The first plug contacts 120 are housed in corresponding passageways 101, respectively. A plurality of airflow recesses 102 are recessed from the front mating face 114 and a plurality of ribs 116 are formed between the airflow recesses 102. Understandably, in this preferred embodiment, each passageway 101 is opened from each airflow recess 102. The plug housing 110 also defined a pair of airflow holes 104 on opposite sides of each passageway 101. When corresponding first plug contacts 120 are inserted in the passageways 101, the airflow holes 104 provide a relative large space for heat dissipation.

Figure 5:
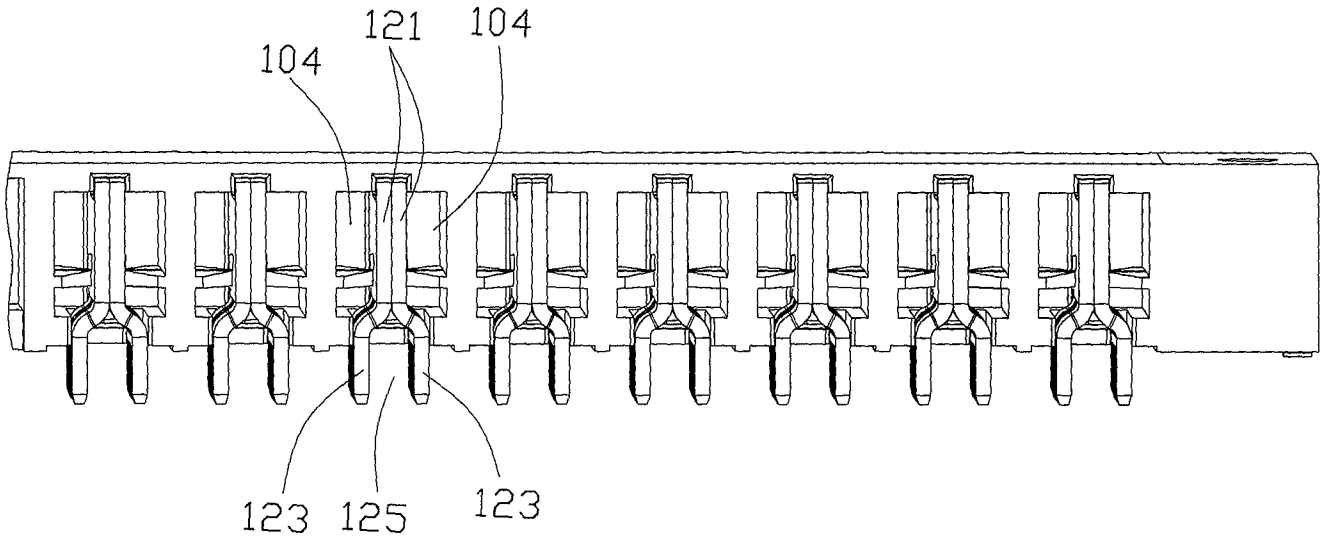
FIG. 5 is a partial, perspective view of the plug shown in FIG. 2.
Figure 6:
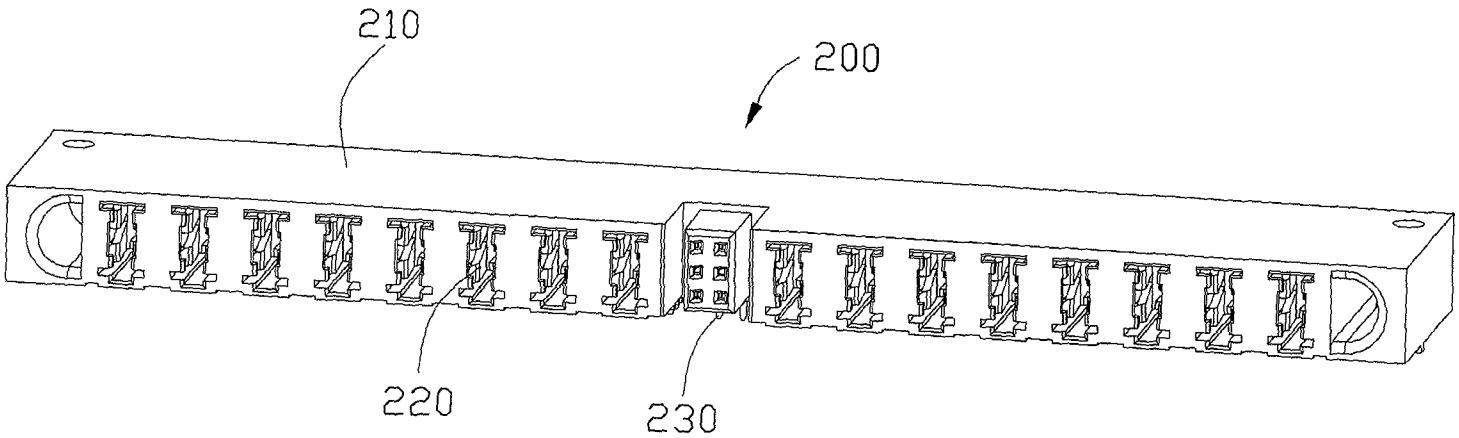
FIG. 6 is a perspective view of a receptacle of the power connector assembly shown in FIG. 1.

Each of the first plug contact 120 is composed by a pair of plug contact elements. The pair of plug contact elements are combined together by a locking portion (not labeled) formed thereon. Each plug contact element has a planar contact blade 122, an array of solder tails 123 extending parallel to the planar contact blade 122, and a connecting portion 121 connecting the planar contact blade 122 and the solder tails 123. An inclined plate 124 extends slantwise from a lower edge of the connecting portion 121 to the array of solder tails 123. When the pair of contact elements are combined together, the contact blade 122 and the connecting portion 121 tightly abut against each other while the two arrays of solder tails 123 are spaced from each other. Referring to FIG. 5, a space 125 is defined between the two arrays of solder tails 123 of the pair of contact elements. In such a manner, the rigidity of the plug contact 120 is improved. In this preferred embodiment, a plurality of through holes (not labeled) are defined in the inclined portion 124 for heat dissipation. The first plug contacts 120 are retained in corresponding passageways 101 with a large region of the plug contact 120 exposed to the airflow holes 104.

The plug housing 110 is also provided with a forwards extended section 113 formed around a middle portion thereof. The forwards extended section 113 defines a rectangular receiving space 103 for receiving the second plug contacts 130. The second plug contacts 130 can be used to transmit signals. Each of the second plug contact 130 includes a mating end 132, a retaining portion 131 for retaining the plug contact 130 in the receiving space 103, and a downwardly extended tail 133. Moreover, a spacer 140 is provided for the second contacts 130 to organize the downwardly extended tails 133 by corresponding receiving holes 141 thereof. In this preferred embodiment, a pair of guiding posts 112 projecting forwards from the front mating face 114.

Turn to FIGS. 6-9, the receptacle 200 includes an elongated, insulating receptacle housing 210. The receptacle housing 210 receives therein a plurality of first receptacle contacts 220 and a second receptacle contacts 230 for mechanically and electrically engaging with corresponding first plug contacts 120 and second plug contacts 130. The receptacle housing 210 forms a top surface 211, a front mating surface 214, and an opposite rear surface 215. A plurality of passageways 201 extend through the front surface 214 and the rear surface 215. Each passageway 201 is formed in an I-shape for receiving respective first receptacle contact 220. A middle section 213 is formed in a middle of the receptacle housing 210 and spaced from the section where the passageways are defined. A plurality of holes 203 are defined therethrough for receiving corresponding second receptacle contacts 230.

Figure 7:
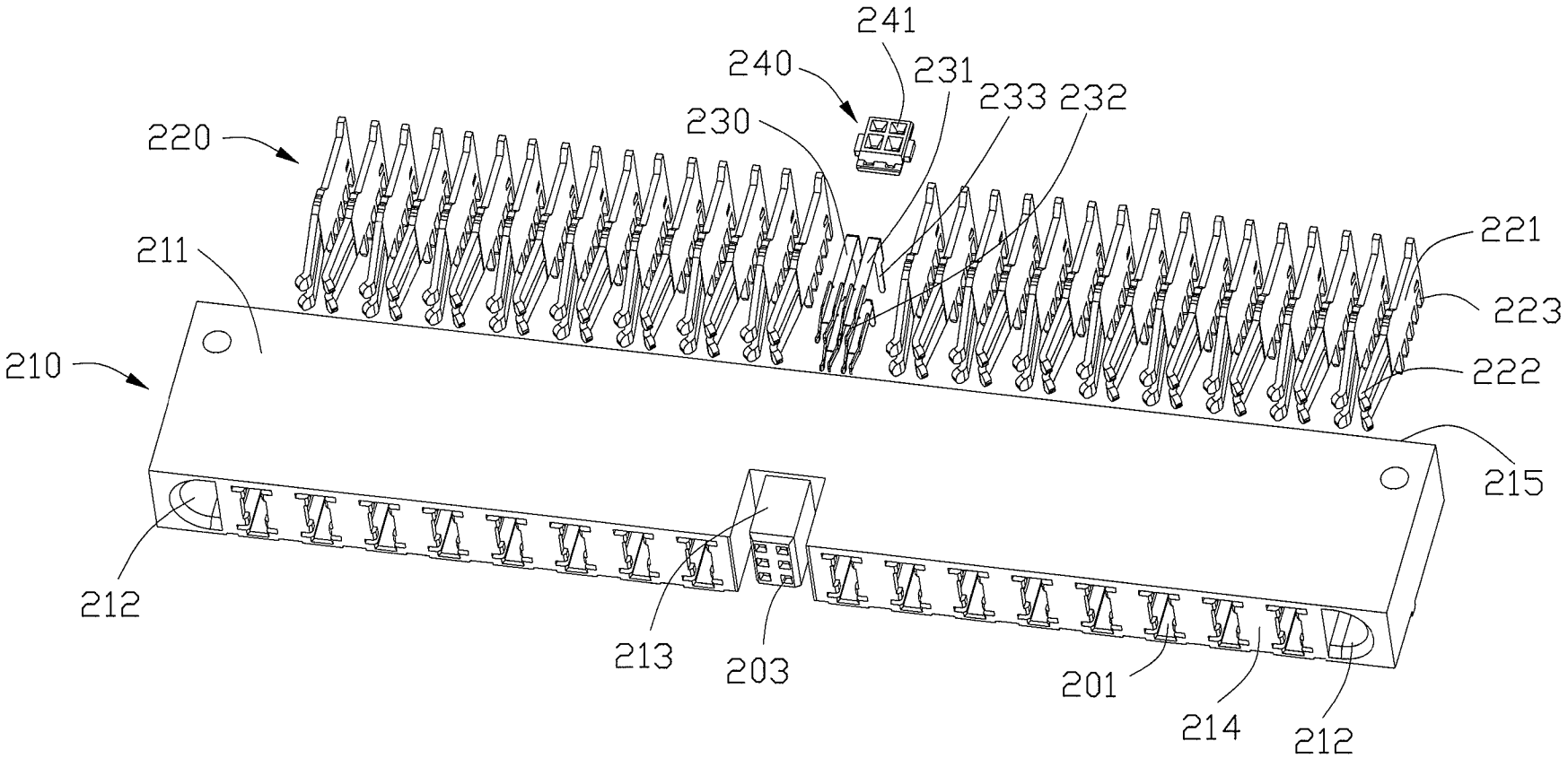
FIG. 7 is an exploded, perspective view of the receptacle shown in FIG. 6.
Figure 8:
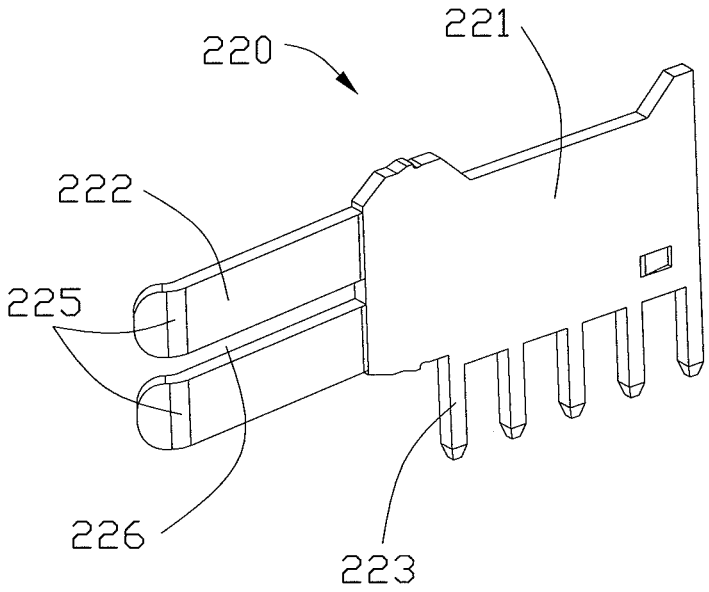
FIG. 8 is a perspective view of one contact element of the receptacle shown in FIG. 7.
Figure 9:
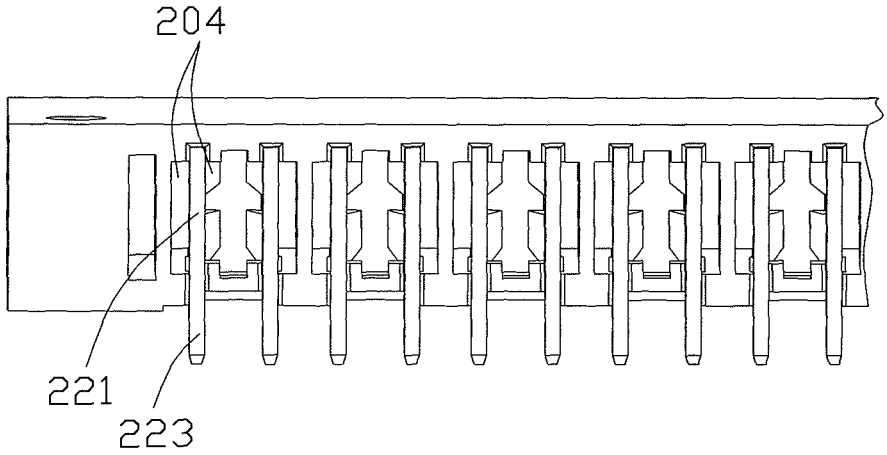
FIG. 9 is a back side view of the receptacle shown in FIG. 6.
Figure 11:
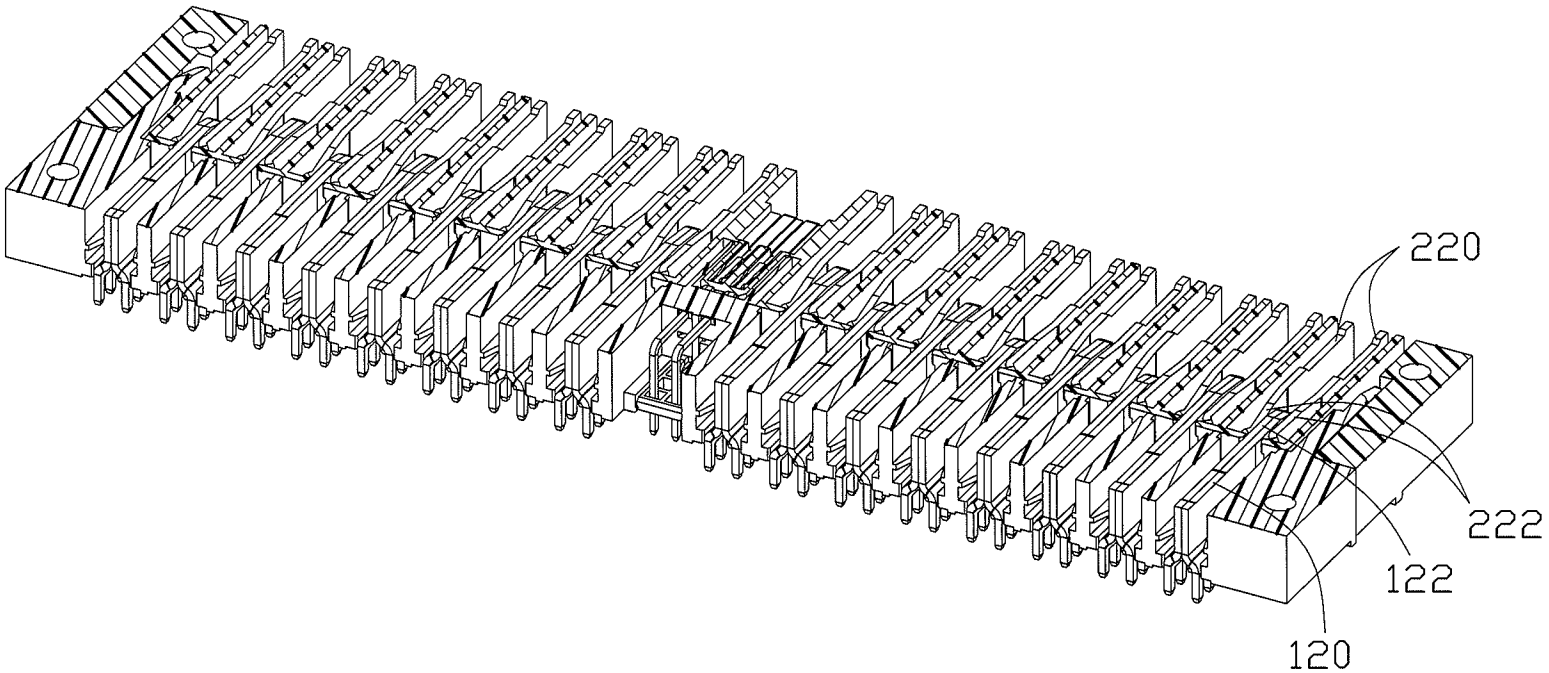
FIG. 11 is a perspective, cross-section view of the power connector assembly shown in FIG. 1.

Each of the first receptacle contacts 220 is composed by a pair of spaced contact halves. Each contact half includes two contact beams 222 with one contact end 225, a planar main portion 221, and a plurality of solder tails 223 extending downwards from a lower edge of the main portion 221. A slot 226 is defined between the two contact beams 222. As shown in FIGS. 7 and 11, each pair of spaced contact halves defines a receiving space (not labeled) between the two pairs of contact beams 222 for receiving the inserted first plug contact 120. Understandably, the receiving space is tapered along the mating direction of the two power connector for resiliently engaging the first plug contact 120. In the preferred embodiment, the pitches between solder tails 223 of every two neighbored contact halves are equal (as shown in FIG. 9).

Each second receptacle contact 230, which is configured to mechanically and electrically connecting with the second plug contact 130, comprises a main portion 231, a contact end 232 extending forwards from the main portion 231, and a solder tail 233 extending downwards from the main portion 231. Similar to the plug connector 100, a separated spacer 240 is provided for organizing the second receptacle contacts 230. A plurality of organizing holes 241 are defined on the spacer 240. The receptacle housing 210 also provides a pair of guiding holes 212 at opposite ends thereof for correspondingly engaging with the guiding posts 112 of the plug connector 110. As can be understood, the guiding holes and the guiding posts forms an engagement device between the two power connectors to thereby guide and lock the two power connectors together.

Figure 10:
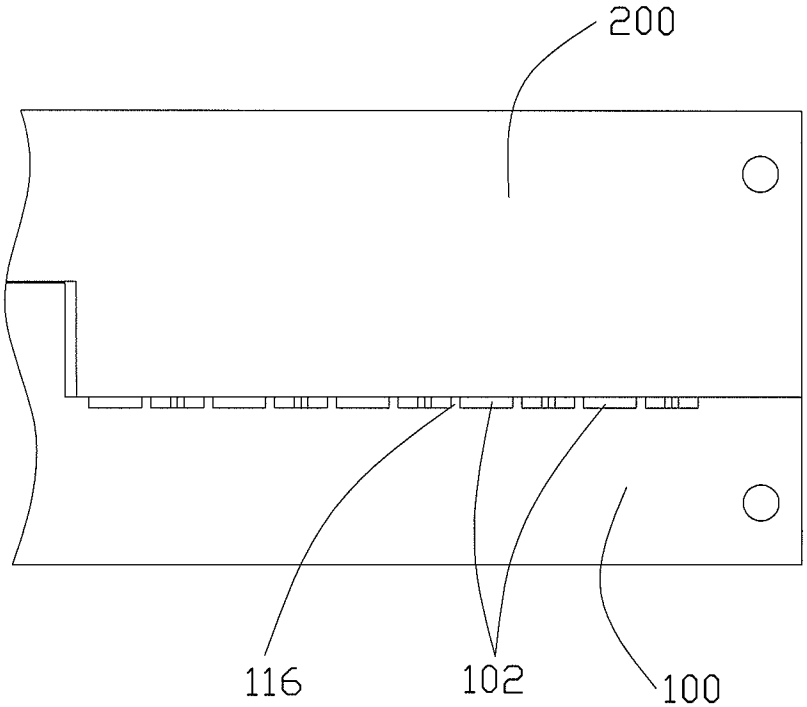
FIG. 10 is a partial, top side view of the power connector assembly shown in FIG. 1.

Referring to FIGS. 10 and 11, a plurality of airflow holes are defined between the receptacle connector 200 and the plug connector 100 when the two power connectors are mated together. In the preferred embodiment, the airflow recess 102 recessed in the plug connector 100 defines such airflow holes. Understandably, the airflow recesses 102 are also can be defined in the receptacle connector 200. In such a way, the heat is quickly dissipated when the two mated power connectors are working. The performance of power transmission between the power connectors can be ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector assembly, comprising:

a first connector comprising a first insulating housing having a front face and a rear face, a plurality of passageways defined in the first insulating housing and extending through the front face and the rear face, and a plurality of first contacts retained in the passageways, respectively; and a second connector comprising a second insulating housing having a front surface and a rear surface, said front surface confronting to and mateable with said front face of the first connector, a plurality of passageways defined in the second insulating housing and extending through the front surface and the rear surface, and a plurality of second contacts retained in the passageways, respectively;

wherein when the first connector and the second connector are mated with each other along a mating direction, a plurality of airflow holes are defined between the front face of the first connector and the front surface of the second connector;

wherein the first connector defines a plurality of airflow recesses recessed from the front face and a plurality of ribs formed between the airflow recesses;

wherein the ribs abut against the front surface of the second connector when the first and the second connectors are mated to each other so that the airflow holes are defined therebetween; and wherein each passageway of the second connector is configured in an I-shape.

2. The power connector assembly as claimed in claim 1, wherein the first insulating housing of the first connector defines a pair of airflow channel at opposite sides of each passageway and throughout the front face and the rear face.

3. The power connector assembly as claimed in claim 1, wherein the second insulating housing of the second connector defines a pair of airflow channel at opposite sides of each passageway and throughout the front surface and the rear surface.

4. The power connector assembly as claimed in claim 1, wherein each first contact is composed by a pair of first contact elements which are tightly combined.

5. The power connector assembly as claimed in claim 4, wherein each first contact element forms a planar contact blade, an array of solder tails extending along a direction parallel to the contact blade, and a connecting portion connecting the contact blade and the solder tails.

6. The power connector assembly as claimed in claim 5, wherein the solder tails of the two first contact elements are spaced from each other.

7. The power connector assembly as claimed in claim 6, wherein an inclined plate extends slantwise from the connecting portion and connects with the array of the solder tails.

8. The power connector assembly as claimed in claim 7, wherein each inclined plate defines thereon at least one through hole for heat dissipation.

9. The power connector assembly as claimed in claim 1, wherein each second contact is composed by a pair of separate contact halves.

10. The power connector assembly as claimed in claim 9, wherein each contact half forms a planar main portion, a pair of contact beams extending forwardly from the planar main portion, and a plurality of solder tails extending downwardly from the planar main portion.

11. The power connector assembly as claimed in claim 10, wherein each second contact defines a receiving space between the two pairs of contact beams of the two contact halves for receiving the inserted first contacts.

12. The power connector assembly as claimed in claim 11, wherein the receiving space between the two contact halves is tapered along the mating direction for resiliently clamping the inserted first contact.

13. The power connector assembly as claimed in claim 1, wherein an engagement device is formed between the first and the second connector for guiding and locking the two connectors along the mating direction.

14. The power connector assembly as claimed in claim 13, wherein the engagement device of the first connector is provided with a guiding post.

15. The power connector assembly as claimed in claim 14, wherein the engagement device of the second connector is provided with a recess for receiving the guiding post of the first connector.

* * * * *